US005590844A

United States Patent [19]

Hatakeyama et al.

[11] Patent Number: 5,590,844

[45] Date of Patent: Jan. 7, 1997

[54] BUNCH WINDING PROCESSING APPARATUS

[75] Inventors: Yasunori Hatakeyama, Shiga-ken; Kenichi Ueda, Kyoto, both of Japan

[73] Assignee: Murata Kikai Kabushiki Kaisha, Kyoto, Japan

[21] Appl. No.: 496,443

[22] Filed: Jun. 29, 1995

[30] Foreign Application Priority Data

Jul. 8, 1994 [JP] Japan ..... 6-157297

[51] Int. Cl.[6] ..... B65H 54/00; B65H 63/00

[52] U.S. Cl. ..... 242/18 EW; 242/18 R; 242/36

[58] Field of Search ..... 242/35.6 E, 18 EW, 242/18 R, 125.2, 36

[56] References Cited

FOREIGN PATENT DOCUMENTS 4-313565 11/1992 Japan .

*Primary Examiner*—Michael R. Mansen

*Attorney, Agent, or Firm*—Armstrong, Westerman, Hattori, McLeland & Naughton

[57] ABSTRACT

The bunch winding processing apparatus includes a yarn putting aside mechanism for moving a feed pawl member, which is adapted to be contacted with a circumferential side face of an end portion of a take-up tube on which a bunch winding is provided, relatively in a circumferential direction to put aside the bunch yarn, and a laser sensor for detecting whether or not a yarn is present at a contacting location of the feed pawl member.

6 Claims, 5 Drawing Sheets

BUNCH WINDING PROCESSING APPARATUS

BACKGROUND OF THE INVENTION

1. Field of the Invention

This invention relates to a bunch winding processing apparatus for processing a bunch winding provided on a package.

2. Related Art Statement

A bunch winding processing apparatus is known as an apparatus which automatically processes a bunch winding on a package produced by a take-up winder or a like machine (the official gazette of Japanese Patent Laid-Open Application No. Heisei 4-313565, and so forth). In the bunch winding processing apparatus, while a bunch portion is held down by a guide, the remaining bunch yarn is drawn out from a take-up tube by means of a suction pipe or a like member, and a seal is adhesively fixed to the held down yarn and the drawn out yarn is cut, sucked and removed in order to process an end yarn at the beginning of the winding to be left on the take-up tube without damaging the end yarn.

However, since bunch windings have a dispersion in configuration and it is difficult to perform fixation of a bunch yarn and so forth with certainty with the conventional apparatus described above, the present applicant has been developing a mechanism wherein a member in the form of a pawl is contacted with the surface of a take-up tube while the take-up tube is rotated to suitably put aside a yarn other than a straight winding yarn. In particular, if a bunch yarn is kept put aside, then succeeding processing can be performed with certainty. However, since it is not known at which position on a circumference of a take-up tube a yarn is present, there is the possibility that, when the member in the form of a pawl is grounded, it may tread a yarn to cause a yarn split, resulting in error in processing. The yarn splitting phenomenon is remarkable above all with a filament yarn, and once the pawl member treads a yarn to cause a yarn split, the yarn split is not naturally eliminated at all.

SUMMARY OF THE INVENTION

Therefore, taking the circumstances described above into consideration, an object of the present invention is to provide a bunch winding processing apparatus which can contribute to improvement in rate of success in bunch processing by securing a yarn putting aside operation.

According to the present invention, a bunch winding processing apparatus comprises a yarn putting aside mechanism for moving a feed pawl member, which is adapted to be contacted with a circumferential side face of an end portion of a take-up tube on which a bunch winding is provided, relatively in a circumferential direction to put aside a bunch yarn, and yarn detection means for detecting whether or not a yarn is present at a contacting point of the feed pawl member. Preferably, the yarn detection means is a laser sensor. Or, the yarn detection means may detect a yarn on the downstream side of the feed pawl member in the direction of rotation of the take-up tube.

In the yarn putting aside mechanism having the construction described above, the feed pawl member is first contacted with a circumferential side face of an end portion of a take-up tube, and then as the take-up tube is rotated, the feed pawl member puts aside a bunch yarn. The yarn detection means detects presence or absence of a yarn when the feed pawl member is to be contacted so that the feed pawl member is grounded to a location where no yarn is present. The laser sensor senses a point of the surface of the take-up tube to detect presence or absence of a yarn. Meanwhile, the yarn detection means which detects a yarn on the downstream side of the feed pawl member in the direction of rotation of the take-up tube prevents treading of a yarn by causing the feed pawl member to be grounded when the yarn detection means detects a yarn.

Figure 1:
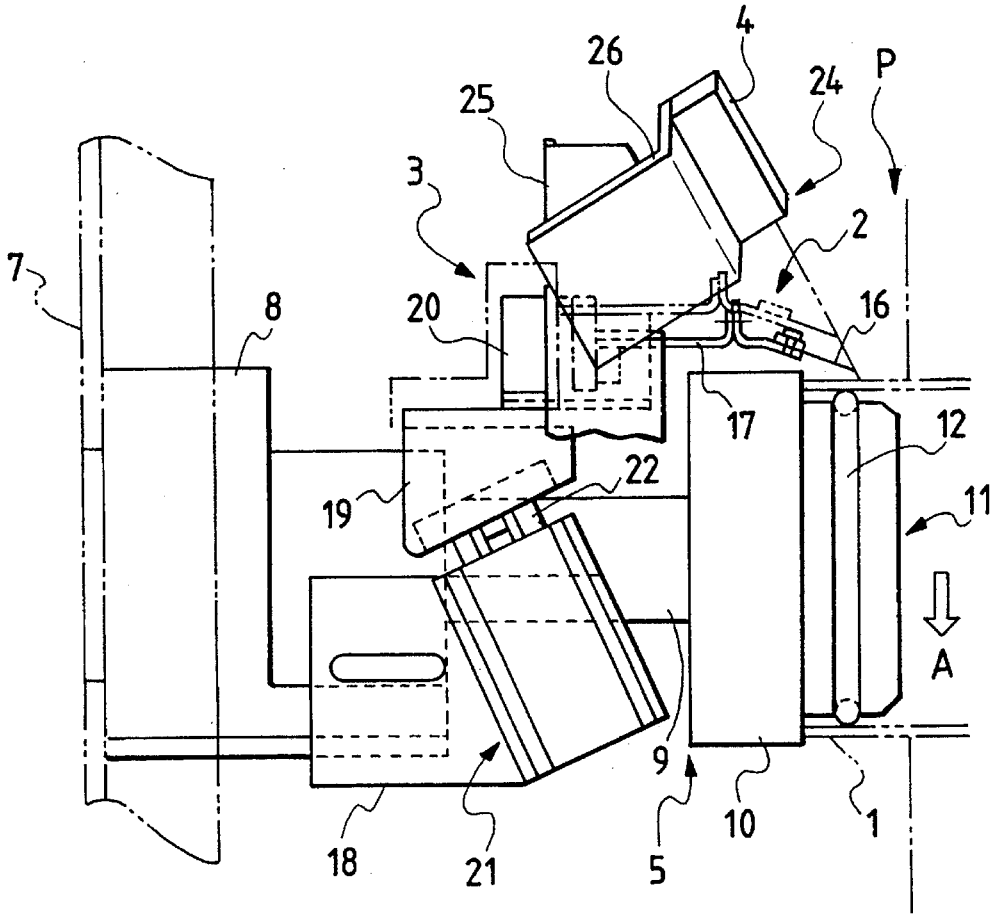
FIG. 1 is a side elevational view showing an embodiment of a bunch winding processing apparatus according to the present invention.
Figure 7:
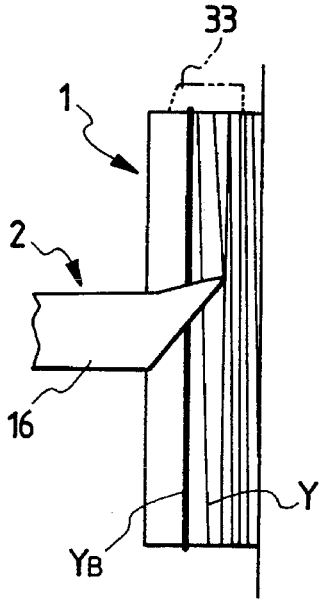
Figure 8:
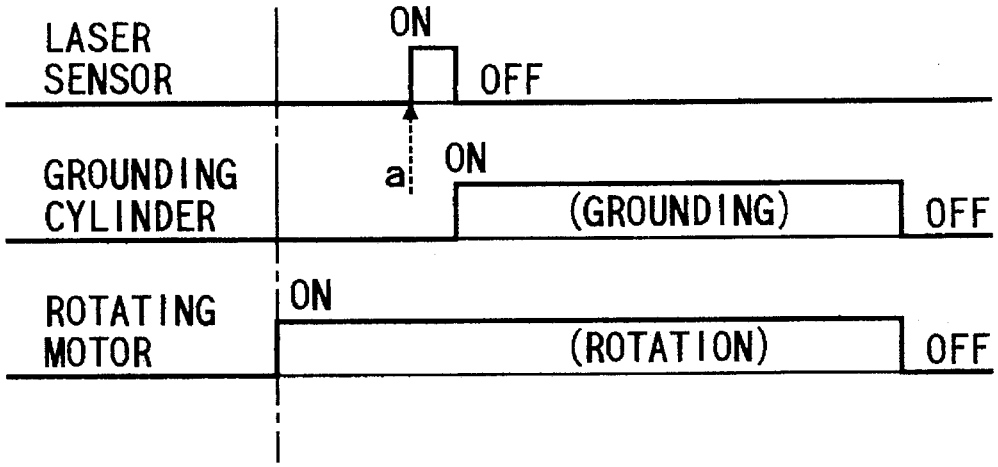

FIGS. *6a* and *6b* are view illustrating operation of FIG. 1, wherein specifically FIG. *6a* is a plan view in a condition wherein absence of a yarn is detected and FIG. *6b* is a plan view in another condition wherein presence of a yarn is detected;

FIG. 7 is a plan view illustrating operation of a yarn putting aside mechanism of FIG. 1;

FIG. 8 is a timing chart illustrating operation of FIG. 1; and

Figure 9:
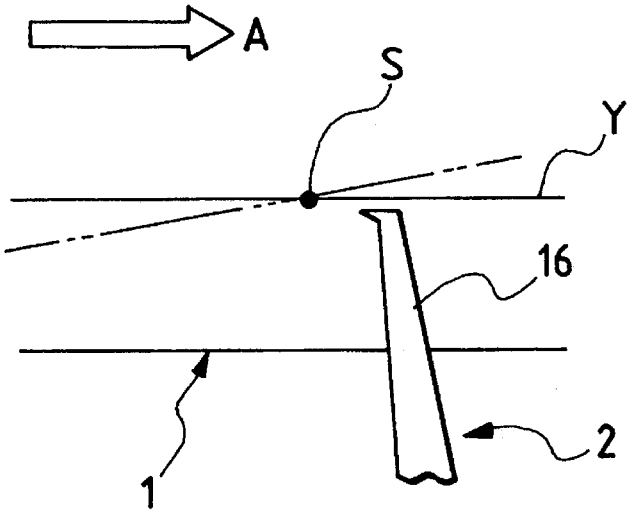

FIG. 9 is a plan view showing an embodiment different from FIG. 6.

DETAILED DESCRIPTION OF PREFERRED EMBODIMENT

In the following, embodiments of the present invention will be described with reference to the accompanying drawings.

Figure 2:
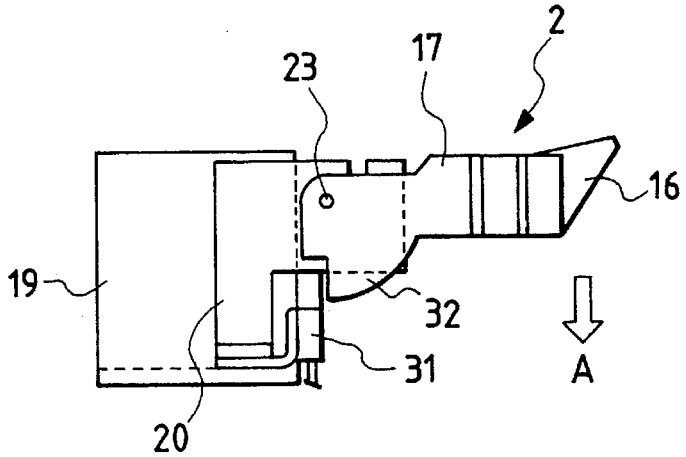
FIG. 2 is a plan view of essential part of FIG. 1.
Figure 3:
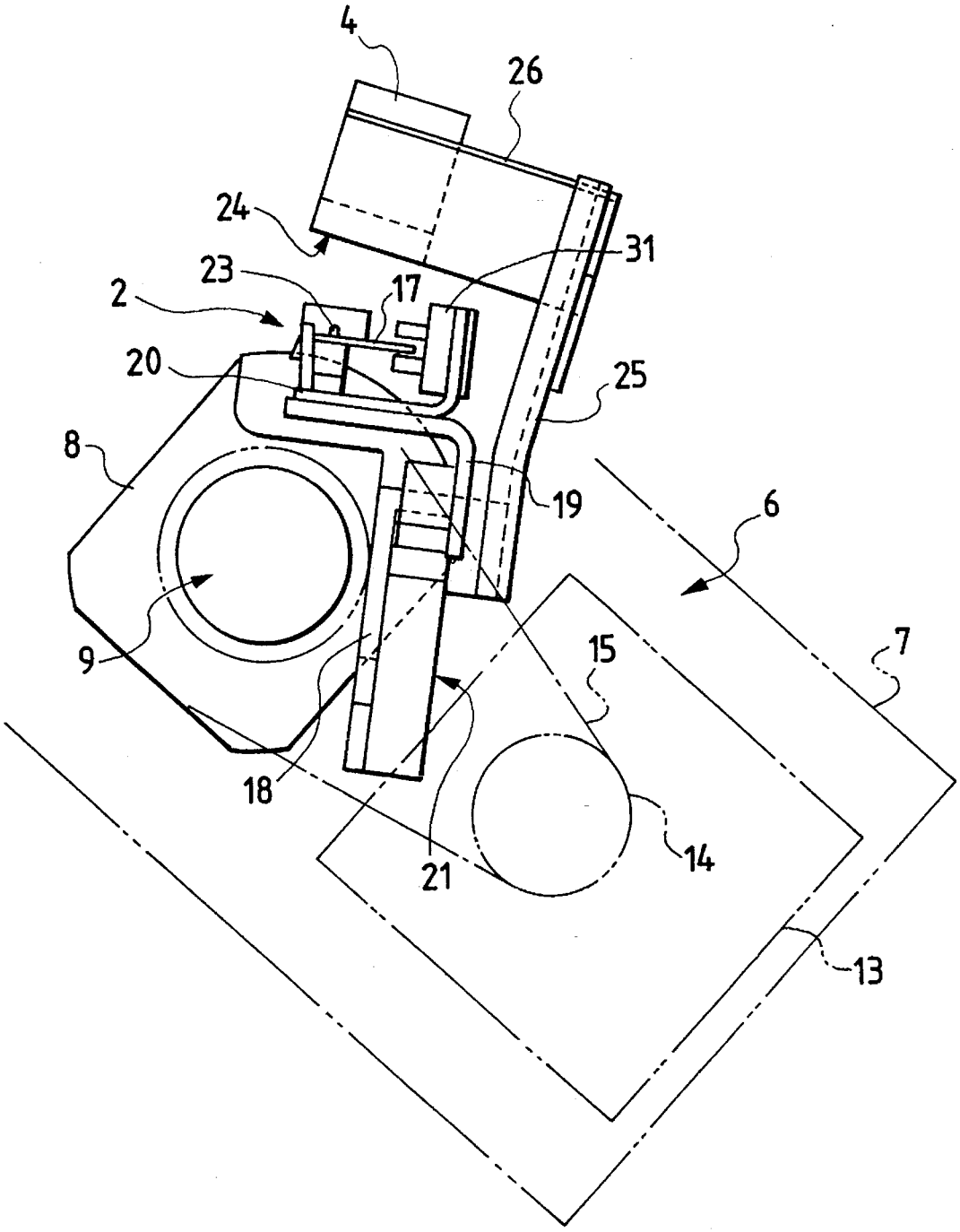
FIG. 3 is a front elevational view of FIG. 1.

FIGS. 1 to 3 show an embodiment of a bunch winding processing apparatus according to the present invention. The bunch winding processing apparatus principally includes a yarn putting aside mechanism 3 including a feed pawl member 2 for contacting with a circumferential side face of an end portion 1 of a take-up tube of a package P, and a laser sensor 4 serving as yarn detection means for detecting whether or not a yarn is present at a contacting location of the feed pawl member 2. The bunch winding processing apparatus further includes grasping means 5 for grasping the package P and rotation means 6 for suitably rotating the package P. The components mentioned are supported on a support frame 7 which is provided for movement in an axial direction of the package P in a processing station (not shown). The grasping means 5 includes a bearing block 8 secured to the support frame 7, and a chuck member 10 supported for rotation on the bearing block 8 by way of a shaft 9. The chuck member 10 has an insertion portion 11 for being inserted into the take-up tube end portion 1 on which a bunch winding is provided, and an O-snap ring 12 fitted in a circumferential groove on the chuck member 10 is suitably expanded in a diametrical direction to grasp the take-up tube. Meanwhile, the rotation means 6 includes a rotating motor 13 mounted on the support frame 7, and a sprocket wheel 14 and a chain 15 for transmitting rotation of the rotating motor 13 to the shaft 9. In particular, by energization of the rotating motor 13, the chuck member 10 is rotated to rotate the package P grasped by the chuck member 10. The direction A of rotation of the take-up tube is opposite to the yarn winding direction (direction in which the package P is rotated upon winding).

The feed pawl member 2 includes a pawl plate 16 in the form of a substantially triangular thin plate having a top end which is so shaped as to suitably contact with the surface of the take-up tube, and a holding plate 17 for holding the pawl plate 16 in a condition wherein it is suitably inclined with respect to the take-up tube end portion 1. The holding plate 17 is supported on the bearing block 8 by way of three bracket plates 18, 19 and 20 and a grounding cylinder 21. An upper portion and a side portion of the bearing block 8 are cut away suitably, and the first bracket plate 18 is mounted on the cut away face of the side portion of the bearing block 8 such that it extends along the shaft 9, and the body of the grounding cylinder 21 is held in a condition wherein it extends obliquely with respect to an axial line of the package. An advancement/retraction rod 22 of the grounding cylinder 21 is directed obliquely upwardly, and the second bracket plate 19 which is suitably bent is mounted at an end of the advancement/retraction rod 22. The bent face of the second bracket plate 19 supports the third bracket plate 20 thereon, and the third bracket plate 20 supports a base end of the holding plate 17 by way of a support shaft 23. In particular, when the grounding cylinder 21 is in an extended condition, the feed pawl member 2 stands by at a location obliquely upwardly of the take-up tube end portion 1 (the position indicated by an alternate long and two short dashes line in FIG. 1), but when the grounding cylinder 21 is contracted, the feed pawl member 2 is moved down into contact with the surface of the take-up tube.

Figure 4:
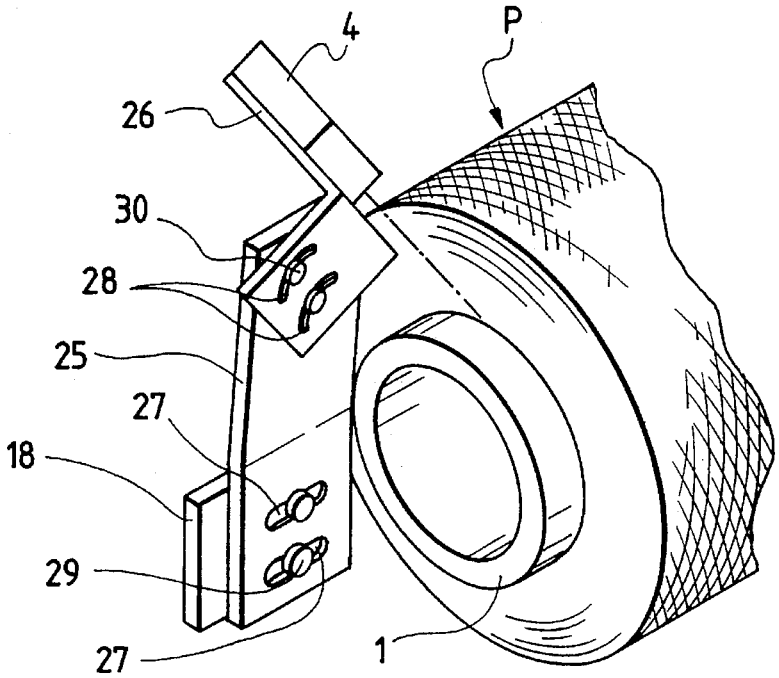
FIG. 4 is a perspective view of essential part of FIG. 3.
Figure 5:
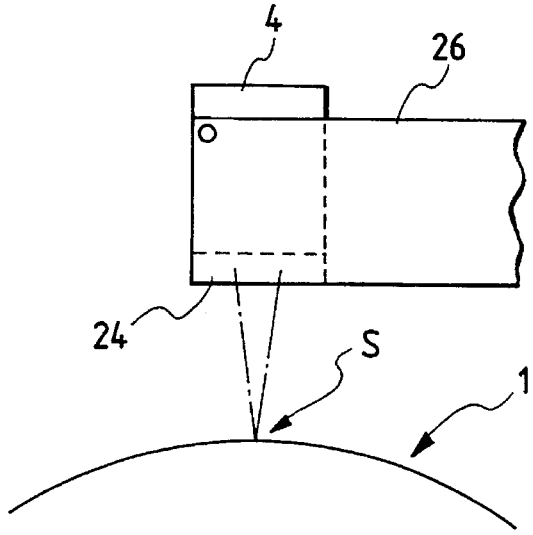
FIG. 5 is a front elevational view of essential part of FIG. 4.
Figure 6A:
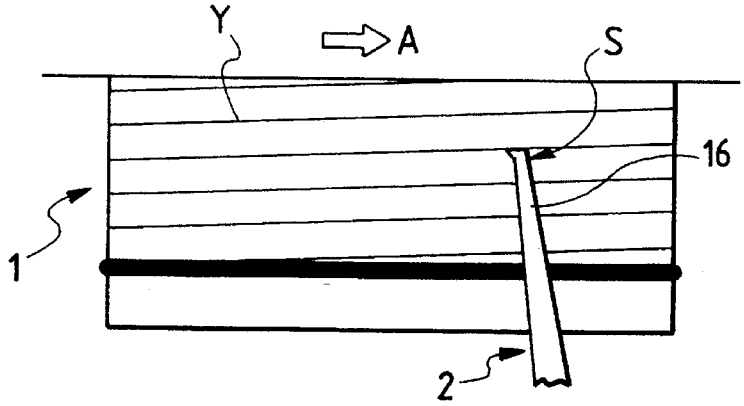
Figure 6B:
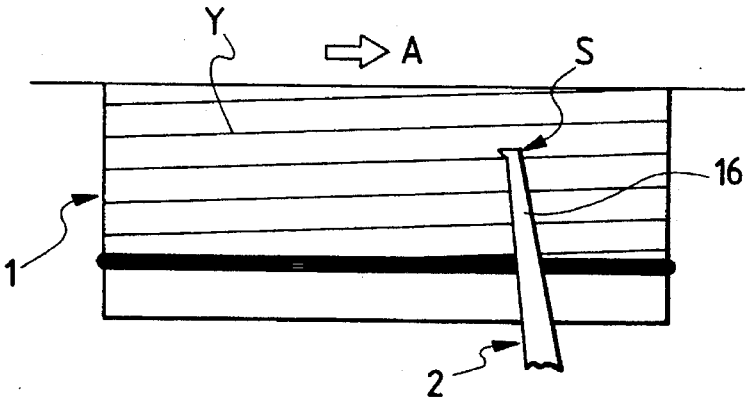

The laser sensor 4 has an end sensing portion 24 including a light emitting element and a light receiving element formed integrally with each other, and is secured to the bearing block 8 by means of two bracket plates 25 and 26 supported on the first bracket plate 18. The first bracket plate 18 partially extends in a radial direction of the take-up tube, and the fourth bracket plate 25 of a substantially rectangular shape is connected to an end portion of the extension of the first bracket plate 18 and extends upwardly. The fifth bracket plate 26 having an L-shaped cross section is mounted at an upper end of the fourth bracket plate 25 and extends obliquely rearwardly of the feed pawl member 2. The laser sensor 4 is mounted on a face portion of the fifth bracket plate 26. As shown in FIG. 4, a pair of linear elongated holes 27 are formed in the fourth bracket plate 25 while a pair of arcuate elongated holes 28 are formed in the fifth bracket plate 26 so that the angle and the distance between the laser sensor 4 and the surface of the take-up tube can be adjusted finely by adjusting the relative positions of fastening screws 29 and 30 fitted in the elongated holes 27 and 28, respectively. Further, as shown in FIG. 5, a laser beam is irradiated upon the surface of the take-up tube and the variation in reflected light is sensed to substantially identify the surface of the take-up tube and a yarn at a detection point S so that presence or absence of a yarn can be detected. As shown in FIGS. 6*a* and 6*b*, the detection point S is set such that it is on the downstream side of the feed pawl member 2 in the direction A of rotation of the take-up tube and, when presence of a yarn is detected, the end of the pawl plate 16 is positioned at a location where a bunch yarn Y in the interior (main winding side) is not present. Accordingly, before the feed pawl member 2 is grounded to the surface of the take-up tube, sensing is performed while the take-up tube (package P) is being rotated, and when the yarn Y is sensed at the detection point S, the feed pawl member 2 is grounded. Then, after the feed pawl member 2 is grounded, the package P is rotated continuously so that the feed pawl member 2 is engaged with the bunch yarn Y and gradually puts aside the bunch yarn Y to the position of the end thereof as shown in FIG. 7.

Further, the third bracket plate 20 includes a rotation sensor 31 provided at a location of the feed pawl member 2 spaced suitably from a base end of the holding plate 17. While the holding plate 17 is held by a spring (not shown) or the like provided on the support shaft 23 such that it extends in a direction of the axial line of the package P, if the number of turns of the bunch winding is insufficient, then the resistance upon a putting aside operation is high as much, and the holding plate 17 is tilted in the direction A of rotation against the biasing force of the spring. The tilting movement is sensed as approach of a base end side portion 32 of the holding plate 17 by the rotation sensor 31, and this is determined as a shortage in winding turn number. If such shortage in winding turn number is detected, a succeeding bunch processing step is intercepted.

Operation of the present embodiment will be described below (refer to FIG. 8).

When a package P is transported to the processing station, the chuck member 10 of the grasping means 5 grasps a take-up tube end portion 1 of the package P as the support frame 7 moves. Then, while the laser sensor 4 continuously measures one point (detection point S) of the surface of the take-up tube, the rotating motor 13 is energized to rotate the shaft 9 and the chuck member 10 to rotate the package P at a predetermined speed. Then, at a point of time when the laser sensor 4 senses presence of a yarn (ON) and then senses absence of a yarn (OFF), the grounding cylinder 21 is operated to lower the feed pawl member 2 to ground the pawl plate 16. The package P is further rotated at least one rotation (rotation by 360 degrees) after the point of time of such grounding so that the engaged bunch yarn Y is put aside to the main winding side into a condition wherein the bunch yarn Y is wound in a circumferential direction at the position of the end of the pawl plate 16.

At processing steps after that, for example, the bunch yarn Y is first held down by a holding down member (refer to reference numeral 33 in FIG. 7), and then a bunch straight winding yarn $Y_B$ is cut by means of a heat cutter or the like. Then, making use of the space, a put aside portion of the bunch winding in the proximity of the end of the pawl plate 16 is fixed by means of a seal, and then the bunch straight winding yarn $Y_B$ and an excessive bunch yarn Y are sucked in a radial direction or an axial direction by a suction member or the like and removed. The order of cutting-fixation-removal may be varied, and only it is required that a condition wherein an end yarn of a predetermined length is fixed to the take-up tube by the seal is accomplished finally.

Since presence or absence of a yarn in the proximity of the feed pawl member 2 is detected by the laser sensor 4 and then the pawl plate 16 is grounded after the package P is rotated so that the bunch yarn Y is moved away from the position of the end of the pawl plate 16 in this manner, a yarn split caused by treading of a yarn by the feed pawl member 2 is prevented, and a yarn putting aside operation is performed precisely and improvement in rate of success in automatic bunch processing is achieved. Further, since the laser sensor 4 senses a very small offset to detect presence or absence of a yarn, presence or absence of a yarn can be detected irrespective of color of a take-up tube or a yarn. Further, in the present embodiment, since the detection point S is located on the downstream side of the feed pawl member 2 in the direction A of rotation, by moving down the feed pawl member 2 at a point of time when the laser sensor changes from "ON" to "OFF", the feed pawl member 2 can be grounded with certainty to the location where no yarn is present irrespective of the winding angle (traverse angle) or thickness of the bunch yarn Y. It is to be noted that the positional relationship between the detection point S of the laser sensor 4 and the feed pawl member 2 may be modified in various manners from that of the present embodiment. If, for example, as shown in FIG. 9, the detection point S is located in the proximity of and on the upstream side of the feed pawl member 2 in the direction A of rotation and the feed pawl member 2 is moved down when presence of a yarn is detected, then no yarn will be caught by the end of the pawl plate 16, and the feed pawl member can be moved down to a position, where no yarn is present, irrespective of the traverse angle. The grounding timing in this instance may be an instant at which the laser sensor 4 changes to "ON" (refer to a broken line arrow mark a in FIG. 8).

Further, the yarn detection means may be, in place of the laser sensor 4 of the present embodiment, a fiber type photoelectric tube if a single color is employed for take-up tubes, or it is also possible to pick up the surface of a take-up tube by means of, for example, a CCD camera and seek a point where no yarn is present by image processing in order to ground the feed pawl member. Further, while, in the present embodiment, the feed pawl member 2 is held fixed after it is grounded, the feed pawl member 2 may otherwise be moved in an axial direction in synchronism with rotation of the package P to arrange the bunch yarn Y spirally. Further, while, in the present embodiment, the package P is rotated to perform detection and putting aside of a yarn, the yarn putting aside mechanism and the yarn detection means may be turned along the surface of the take-up tube while the package P is fixed.

In summary, according to the present invention, the following superior advantages are exhibited.

(1) With the construction of the present invention, the feed pawl member can be grounded to a position on a take-up tube where no yarn is present, and a yarn split by treading of a yarn can be prevented and a yarn putting aside operation can be performed with certainty.

(2) Further, with the construction of the present invention, since presence or absence of a yarn is detected from an offset between a take-up tube and a bunch yarn, a yarn can be detected with certainty without being influenced by the color of the take-up tube or the like.

(3) Still further, with the construction of the present invention, since the feed pawl member is moved down at a point of time when the sensor changes from detection of presence of a bunch yarn to detection of absence of a yarn, the feed pawl member can be grounded to a position where no bunch yarn is present without fail.

While the invention has been particularly shown and described in reference to preferred embodiments thereof, it will be understood by those skilled in the art that changes in form and details may be made therein without departing from the spirit and scope of the invention.

What is claimed is:

1. A bunch winding processing apparatus, comprising:

a take-up tube having an end portion with a peripheral surface that is provided with a bunch winding thereon;

a feed pawl member which abuts said peripheral surface of said end portion of said take-up tube;

means for moving said feed pawl member in a circumferential direction relative to said take-up tube and putting aside a yarn of the bunch winding on said take up tube; and means for detecting whether said yarn is present or not at the point where said feed pawl member abuts said peripheral surface of said end portion.

2. A bunch winding processing apparatus as recited in claim 1, wherein said means for detecting said yarn includes a laser sensor.

3. A bunch winding processing apparatus as recited in claim 1, wherein said means for moving said feed pawl member further comprises means for grasping said take-up tube and means for rotating said take-up tube, wherein said take-up tube rotates in a direction which is reversed to the winding direction of said yarn of the bunch winding wound around said take-up tube.

4. A bunch winding processing apparatus as recited in claim 3, wherein a mechanism for putting aside said yarn of bunch winding further comprises a rotation sensor for detecting a tilting movement of said feed pawl member, said rotation sensor judging shortage of the number of turns of said bunch winding based on the tilting movement detected thereby.

5. A bunch winding processing apparatus as recited in claim 1, wherein said means for detecting detects said yarn on the downstream side of said feed pawl member in said direction of rotation of said take-up tube.

6. A bunch winding processing apparatus as recited in claim 1, wherein said means for detecting detects presence or absence of said yarn of the bunch winding at a point adjacent to said feed pawl member and on the upstream side thereof in said direction of rotation of said take-up tube, and wherein said feed pawl member is moved down when said yarn is detected.

* * * * *